US005237806A

United States Patent [19]

Braxmeier

[11] Patent Number: 5,237,806

[45] Date of Patent: Aug. 24, 1993

[54] SPINNING MACHINE HAVING A BELT CONVEYOR WITH TENSION INSERTS

[75] Inventor: Hans Braxmeier, Süssen, Fed. Rep. of Germany

[73] Assignee: Spindelfabrik Süssen, Schurr, Stahlecker & Grill GmbH, Fed. Rep. of Germany

[21] Appl. No.: 846,701

[22] Filed: Mar. 6, 1992

[30] Foreign Application Priority Data

Mar. 29, 1991 [DE] Fed. Rep. of Germany ..... 4110449

[51] Int. Cl.[5] ..... D01H 1/42; D01H 13/04

[52] U.S. Cl. ..... 57/90; 57/315; 57/352

[58] Field of Search ..... 57/90, 75, 352, 315, 57/1 R; 226/171; 198/847

[56] References Cited

U.S. PATENT DOCUMENTS

| | | | |
|---|---|---|---|
| 2,896,269 | 7/1959 | Gardella et al. | 57/315 X |
| 3,312,050 | 4/1967 | Noguera | 57/90 |
| 3,509,006 | 4/1970 | Baxendale et al. | 198/847 X |
| 3,844,098 | 10/1974 | Plate et al. | 57/75 X |
| 3,880,274 | 4/1975 | Bechtloff et al. | 198/847 |
| 4,109,543 | 8/1978 | Foti | 198/847 |
| 4,770,290 | 9/1988 | Eroskey et al. | 198/847 |

FOREIGN PATENT DOCUMENTS

| | | | |
|---|---|---|---|
| 1179840 | 10/1964 | Fed. Rep. of Germany | 57/90 |
| 1015780 | 1/1966 | United Kingdom . | |

*Primary Examiner*—Joseph J. Hail, III
*Attorney, Agent, or Firm*—Evenson, McKeown, Edwards & Lenahan

[57] ABSTRACT

In the case of a spinning machine having several spinning stations for the spinning of slivers into yarns, the slivers are transported from cans to the spinning stations by transport devices which comprise transport belts. The transport belts are provided with tension inserts which are covered by the closed smooth lateral edges of the basic material of the transport belts.

6 Claims, 2 Drawing Sheets

SPINNING MACHINE HAVING A BELT CONVEYOR WITH TENSION INSERTS

BACKGROUND AND SUMMARY OF THE INVENTION

This invention relates to spinning machine having several spinning stations for spinning slivers to yarns and having transport devices for the withdrawal of the slivers from cans and for feeding them to the spinning stations, the transport devices comprising transport belts, the width of which is adapted to the thickness of one or several transport belts.

It is known (British Patent Document 1 015 780) to feed slivers to a ring spinning machine in cans. The slivers are withdrawn from the cans by way of rolls and are then guided to pairs of transport belts which receive the slivers between one another and transport them to the drafting units of the ring spinning machine.

It is an object of the invention to develop a spinning machine of the initially mentioned type in such a manner that relatively fine slivers with a size of from approximately Nm 0.4 to approximately Nm 0.8 can be fed without the occurrence of faulty drafts in the slivers during the transport.

This object is achieved according to preferred embodiments of the invention in that the transport belts are provided with tension inserts which are arranged at a distance to the closed lateral edges of the transport belts.

The invention is based on the recognition that a perfect feeding of the slivers without unintentional drafts will only be possible if the transport belts have such a high tensile strength that they themselves do not stretch during the travel from the cans to the drafting units because such stretching of the transport belts would lead to a drafting of the slivers and thus to a disturbance of the spinning operation. In this case, care is also taken at the same time that the inserts, particularly in the area of the lateral edges of the transport belts are not exposed because otherwise fibers may become hung up on them which may also be the reason for a disturbance of the spinning operation. This is reliably prevented by means of the closed smooth lateral edges covering the tension inserts.

In a further development of the invention, it is provided that the transport belts are strip-shaped blanks made of a web-shaped belt, the width of which amounts to a multiple of the width of the individual transport belts. In this manner, an economical manufacturing of the transport belts is possible which themselves have only a relatively small width. In a further development, it is provided that the belt, which is manufactured in a web-shape, is provided with tension inserts extending in its longitudinal direction, between which an insert-free intermediate space is left in each case. This intermediate space has the purpose of cutting the web-shaped belt into individual strip-shaped blanks for the relatively narrow transport belts. By means of this cutting, the inserts will then not be exposed so that smooth closed lateral edges exist in the case of the individual transport belts.

In a further development of the invention, it is provided that the tension inserts are embedded into a basic material made of plastic.

Other objects, advantages and novel features of the present invention will become apparent from the following detailed description of the invention when considered in conjunction with the accompanying drawings.

DETAILED DESCRIPTION OF THE DRAWINGS

Figure 1:
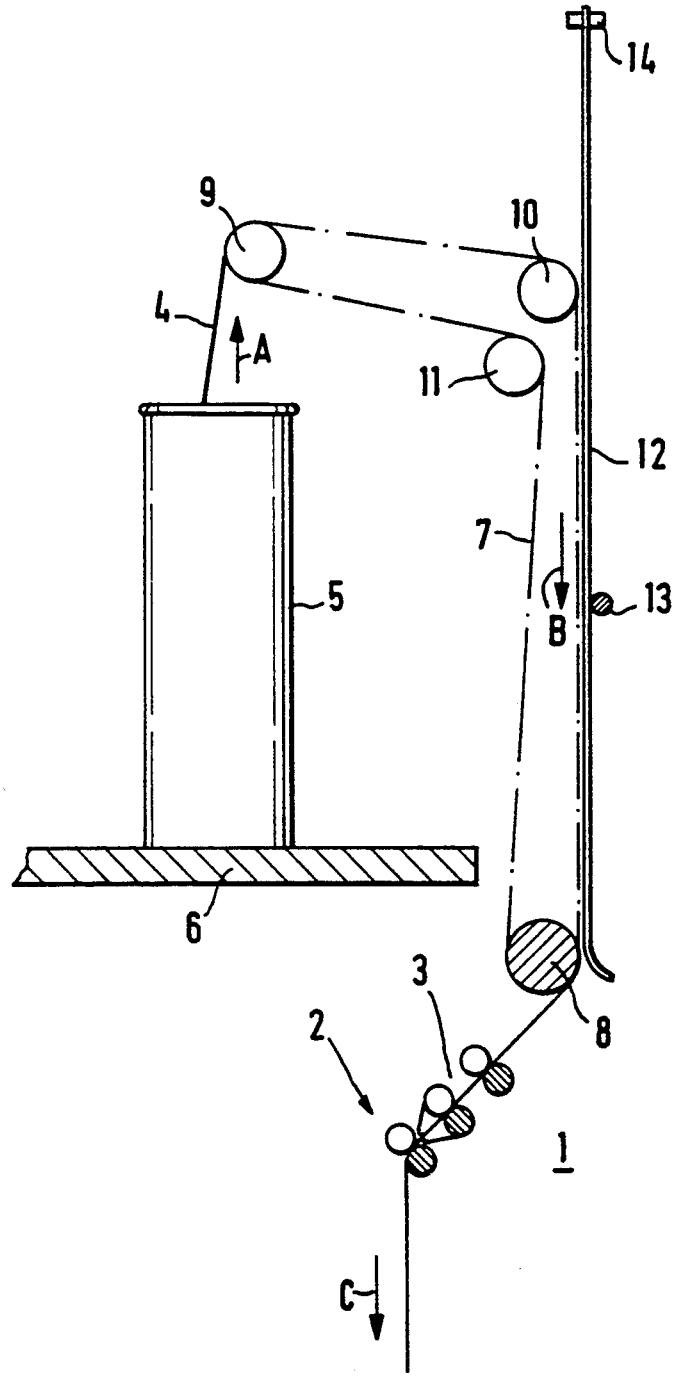
FIG. 1 is a schematic representation of a partial cross-sectional view of a spinning machine constructed according to a preferred embodiment of the invention, to the spinning stations of which a sliver is fed in cans which is transported from the cans to the drafting units by means of transport belts.

FIG. 1 only outlines a spinning machine 1 which may, for example, be a ring spinning machine. Such a spinning machine 1 normally has a plurality of spinning stations 2 on both sides of the machine, in which case FIG. 1 only shows the three-cylinder drafting unit 3 of an individual spinning station 2. In the case of a ring spinning machine, the drafted sliver 4 travels in the direction of the arrow (C) to a ring spindle which is not shown.

A sliver 4 to be spun, which is withdrawn from cans 5, is fed to each spinning station 2. Since the cans 5 normally have a diameter which is larger than the spacing of the spinning stations 2, they are deposited in several rows on each side of the machine. In the shown embodiment, the cans 5 are disposed above the spinning machine 1 on a platform.

In order to be able to use three-cylinder drafting units 3 and to ensure that the feeding rollers of the drafting units 3 rotate at a sufficiently high rotational speed for ensuring concentricity, slivers 4 of a size of approximately Nm 0.4 to approximately Nm 0.8 are spun. These slivers 4 are withdrawn in the direction of the arrow (A) upward from the respective can 5. The transport of the slivers 4 takes place by means of angularly arranged transport belts 7 which are each assigned to a spinning station 2 or possibly to two adjacent spinning stations 2; that is, to those spinning stations whose drafting units 3 are equipped with joint pressure roller pairs. The transport belts 7 lead the slivers 4 first from an area above the cans 5 to the machine center and there in the direction of the arrow (B) downward into the area of the drafting units 3. For this purpose, corresponding deflection pulleys 8, 9, 10, 11 are provided, of which preferably the deflection pulley 8 situated in the area of the drafting unit inlet is arranged on a drivable shaft extending through in the longitudinal direction of the machine. In the vertical guiding section (direction of arrow B); that is, in the section between the driving pulley 8 and the deflection pulley 10, the slivers 4 are held between the transport belts 7 and skids 12 which rest with a slight pressure against the section of the transport belts 7 which extends downward. The skids 12 are suspended on a rail 14, by means of their upper end, extending through in the longitudinal direction of the machine. In the area of the vertical section, the skids 12 are deflected into the direction of the transport belts 7 by means of a rod 13 extending through in the longitudinal direction of the machine.

The approximately horizontally extending sections of the transport belts 7 between the deflection pulleys 9 and 10, on which the slivers 4 rest, reach to approximately centrically over the center of the pertaining can 5. In the case of a two-sided machine, the transport belts 7 and the skids 12 for both machine sides are arranged mirror-symmetrically with respect tothe machine center, in which case naturally two or more rows of cans 5 are then also deposited mirror-invertedly on the platform 6.

In order to ensure that the transport belts 7, which are relatively thin and narrow, do not stretch during their running, particularly in the area of the skid 12 and, as a result, cause a draft of the fine slivers 4, the transport belts 7 are provided with inserts, as illustrated by means of FIGS. 2 to 7. These tension inserts provide that the transport belts 7 only have a relatively slight stretching in their running direction. In this case, the tension inserts are embedded inside the transport belts 7 such that these have smooth closed lateral edges 15 and 16 so that the risk is avoided that in this area fiber or the like may be caught and collected on the transport belts 7.

Since the transport belts 7 have a relatively small width; that is, a width of a magnitude of approximately 30 to approximately 60 mm, but have a relatively large transport path which is in the magnitude of at least from 2 m to approximately 4 m, an economical manufacturing of the transport belts 7 is achieved in that a web-shaped belt is produced from which the individual transport belts 7 are cut out as strip-shaped blanks. These blanks are then connected with one another at their ends, if possible, without joints, for example, by means of gluing or vulcanizing or the like, so that an endless transport belt 7 is obtained. The strip-shaped blanks, which form the transport belts, have cutting edges 15, 16 as lateral edges which are spaced away from the tension inserts 18, 19, 20, 21 so that these do not project toward the outside. Thus, closed smooth cutting edges are obtained. In order to achieve this, it is provided that the tension inserts 18, 19, 20, 21 are arranged such in the web-shaped belt that intermediate areas exist in which the cuts may be guided which result in the cutting edges 15, 16, without exposing the tension inserts 18, 19, 20, 21 as a result. As shown in FIGS. 4 to 7, all tension inserts 18, 19, 20, 21 are embedded into the basic material 17 which is a relatively elastic rubber-type plastic material.

Figure 2:
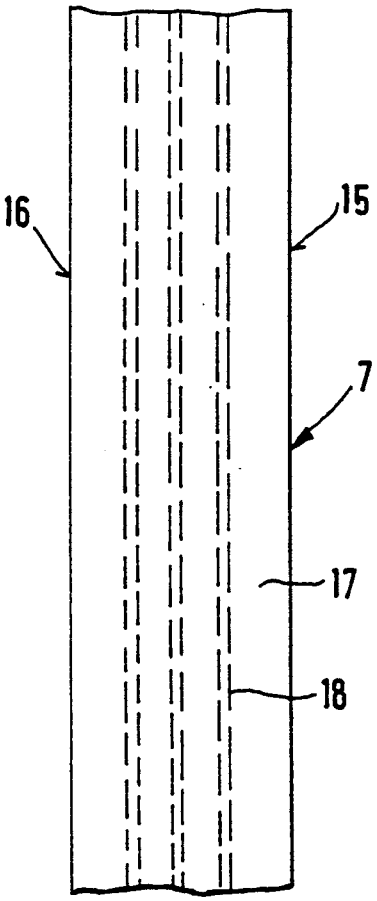
FIGS. 2 and 3 are one top view respectively of embodiments of transport belts corresponding to the invention.
Figure 3:
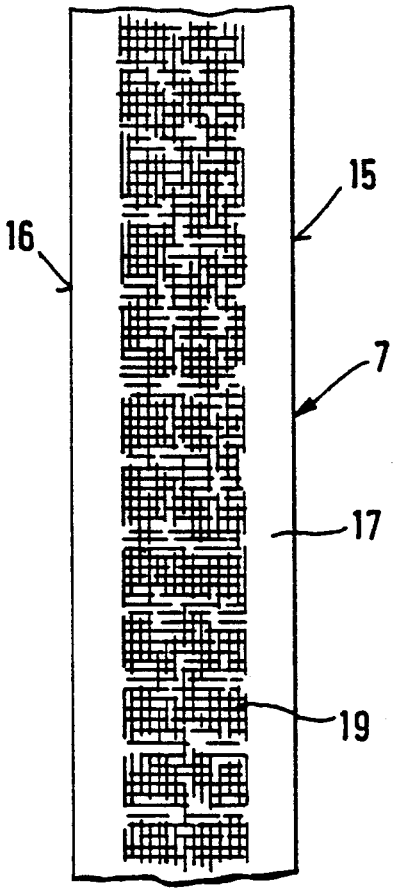
Figure 4:
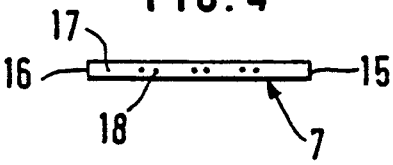
FIGS. 4 to 7 are cross-sectional views through respective different embodiments of transport belts according to the invention, in which case, for reasons of representation, the transport belts are not hatched in the area of their basic material.
Figure 5:
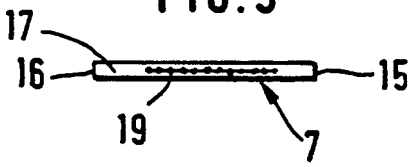

In the case of the embodiment according to FIGS. 2 and 4, bendable metal wires or filament yarns which are each arranged in pairs are used as the tension inserts 18. In the embodiment according to FIGS. 3 and 5, a woven strip 19 is provided as a tension insert which consists of a metallic cloth or a textile cloth.

Figure 6:
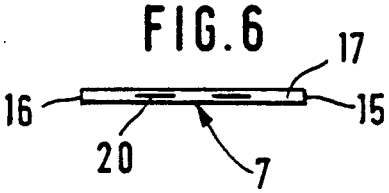
Figure 7:
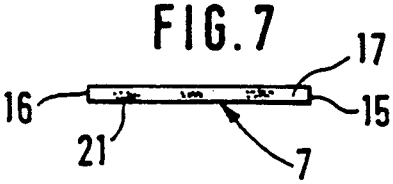

In the embodiment according to FIG. 6, cords 20 are used as tension inserts for each blank forming a transport belt 7. These cords 20 are arranged approximately symmetrically with respect to the center of the respective transport belt 7 but have a relatively large distance to the lateral cutting edges 15, 16. In the embodiment according to FIG. 7, each of the transport belts 7 is provided with tension inserts 21 in the form of yarns or wires which are arranged in three groups being distributed symmetrically with respect to the center of the transport belt 7. Here also, a clear distance is maintained between the two outer groups with respect to the cutting edges 15, 16.

Although the invention has been described and illustrated in detail, it is to be clearly understood that the same is by way of illustration and example, and is not to be taken by wa of limitation. The spirit and scope of the present invention are to be limited only by the terms of the appended claims.

What is claimed:

1. A spinning machine comprising:

a plurality of spinning stations for spinning slivers to yarns, the spinning stations having drafting units;

transport devices for the withdrawal of slivers from cans and for feeding them to the spinning stations, the transport devices being arranged between the cans and the drafting units, the transport devices comprising transport belts and skids along at least a portion of a sliver transport path, the skids interacting with the transport belts and the slivers being guided between the skids and the transport belts so as to be in direct contact with at least one of the skids and at least one of the transport belts, the lateral width of each transport belt being adapted to the thickness of at least one sliver;

wherein the transport belts are provided with tension inserts which are arranged at a distance from closed lateral edges of the transport belts.

2. A spinning machine according to claim 1, wherein the tension inserts are embedded in a basic material made of plastic.

3. A spinning machine according to claim 2, wherein the transport belts are provided with strand-shaped tension inserts made of metal wire or filaments.

4. A spinning machine according to claim 2, wherein the transport belts are each provided with tension inserts made of at least one fabric strip.

5. A spinning machine according to claim 1, wherein the transport belts are provided with strand-shaped tension inserts made of metal wire or filaments.

6. A spinning machine according to claim 1, wherein the transport belts are each provided with tension inserts made of at least one fabric strip.

* * * * *